United States Patent [19]

Zoppa

[11] Patent Number: 4,689,938

[45] Date of Patent: Sep. 1, 1987

[54] AUTOMATIC WRAPPING MACHINE COMPRISING A TENSIONING AND FASTENING DEVICE

[75] Inventor: Dieter Zoppa, Balve, Fed. Rep. of Germany

[73] Assignee: PKM Verpackungssysteme GmbH & Co., Garbeck, Fed. Rep. of Germany

[21] Appl. No.: 839,174

[22] Filed: Mar. 12, 1986

[30] Foreign Application Priority Data

Mar. 13, 1985 [DE] Fed. Rep. of Germany ..... 3504835
Mar. 13, 1985 [DE] Fed. Rep. of Germany ..... 3508837

[51] Int. Cl.[4] ..... B65B 13/02

[52] U.S. Cl. ..... 53/582; 53/373; 100/33 PB; 156/502; 156/583.1

[58] Field of Search ..... 53/589, 582, 373; 100/33 PB; 156/502, 583.1

[56] References Cited

U.S. PATENT DOCUMENTS 3,771,436 11/1973 Sato ..... 100/33 PB
4,120,239 10/1978 Pasic ..... 100/33 PB
4,240,865 12/1980 Kyts ..... 100/33 PB
4,244,773 1/1981 Siebeck ..... 53/589 X
4,575,994 3/1986 Takami ..... 53/589 X

*Primary Examiner*—John Sipos
*Attorney, Agent, or Firm*—Cushman, Darby & Cushman

[57] ABSTRACT

An automatic wrapping machine including a guiding device for guiding a wrapping band from a supply, a loop forming device for looping the wrapping band around an object and a tensioning and fastening apparatus for the wrapping band. The tensioning and fastening apparatus includes a driving assembly, a tensioning assembly, a pair of wrapping band holders, an electrode plunger, and a movable plate assembly. The movable plate assembly preferably includes an upper plate and a lower plate which are slidable relative to one another so as to expose a counter electrode mounted on the lower plate when fastening or welding of the looped band is desired. The movable plate assembly is also preferably mounted for reciprocal movement relative to the frame of the apparatus to enable removal of the welded band loop.

8 Claims, 10 Drawing Figures

V
55'
54'
53
64
55
56
54
52
10
41
47
63
1
58'
40
77
46
45
72
58
61
48
44
36
31
2
33
33'
78
77
21
III
IV
IV
III
II
II
V
57
50
51
49
42
35
32
38
37
30
20
3
4
P
15
16
17
6
12
1

AUTOMATIC WRAPPING MACHINE COMPRISING A TENSIONING AND FASTENING DEVICE

The invention relates to an automatic wrapping machine comprising a tensioning and fastening device. An automatic wrapping machine of the above-indicated type is known from DD-A No. 50 487. The adjustable plate which supports the counter electrode, is mounted to a linkage which, in turn, is rigidly mounted to another lever and adapted to swing out from the effective region of the holder plungers with an arcuate motion, when the welding or heat sealing operation is finished. This machine suffers from the drawback that the cantilevered mounted plate must bear substantial forces and torques, necessitating proportionally large dimensions of the plate. Further, deformations and therefore probably also poor welding results may occur under the high plunger pressures required.

In consideration of this conventional machine it is therefore the object of the invention to provide an automatic wrapping machine which includes in the vicinity of the tensioning and sealing device such components which reliably receive the high pressing forces, which enjoy long operational life, and which nevertheless permit rapid pivoting or swinging and, thus, releasing of the wrapping band from the fastening device.

These objects are solved in that the adjustable plate including the counter electrode is adapted to be reciprocated or be shifted in the manner of a sledge or carriage in the plane of the overlapping region.

In this way, the plate including the counter electrode may be moved to the region of the plunger elements by being supported from opposite sides against tilting. The wrapping band is reliably held in one plane, and long service life can be expected.

The adjustable plate may be retracted and extended by, for example a lever and a bearing shoe fitted thereto and in which the end of a moving lever rotates. The lever as such may be operated by hydraulic or mechanical means, e. g. by cam actuation.

It is particularly preferable when the adjustable plate comprises a pair of plate elements slidably fitted one onto the other, namely an upper and a lower slide plate each which have stops spaced in the sliding direction, with one of the slide plates carrying the bearing shoe. In this way, graduated motions of the pair of slide plates may be produced, thereby facilitating both the exact alignment of the band and securing the precise position of the pair of overlapping bands in the region of the fastening device.

Preferably, the lower slide plate has the upper slide plate moving there across in such a manner that a guide channel, present in the upper slide plate, is positioned above the counter electrode. This guide channel serves to receive and precisely place the wrapping band. Advantageously, a stop lever may be further provided at the end of the guide channel, which lever is rotated upon contact or abutment with the end of band to initiate a switching operation by such rotation.

In order to more clearly illustrate the invention, two embodiments are described below, which are shown in the Figures, wherein.

Figure 6A:
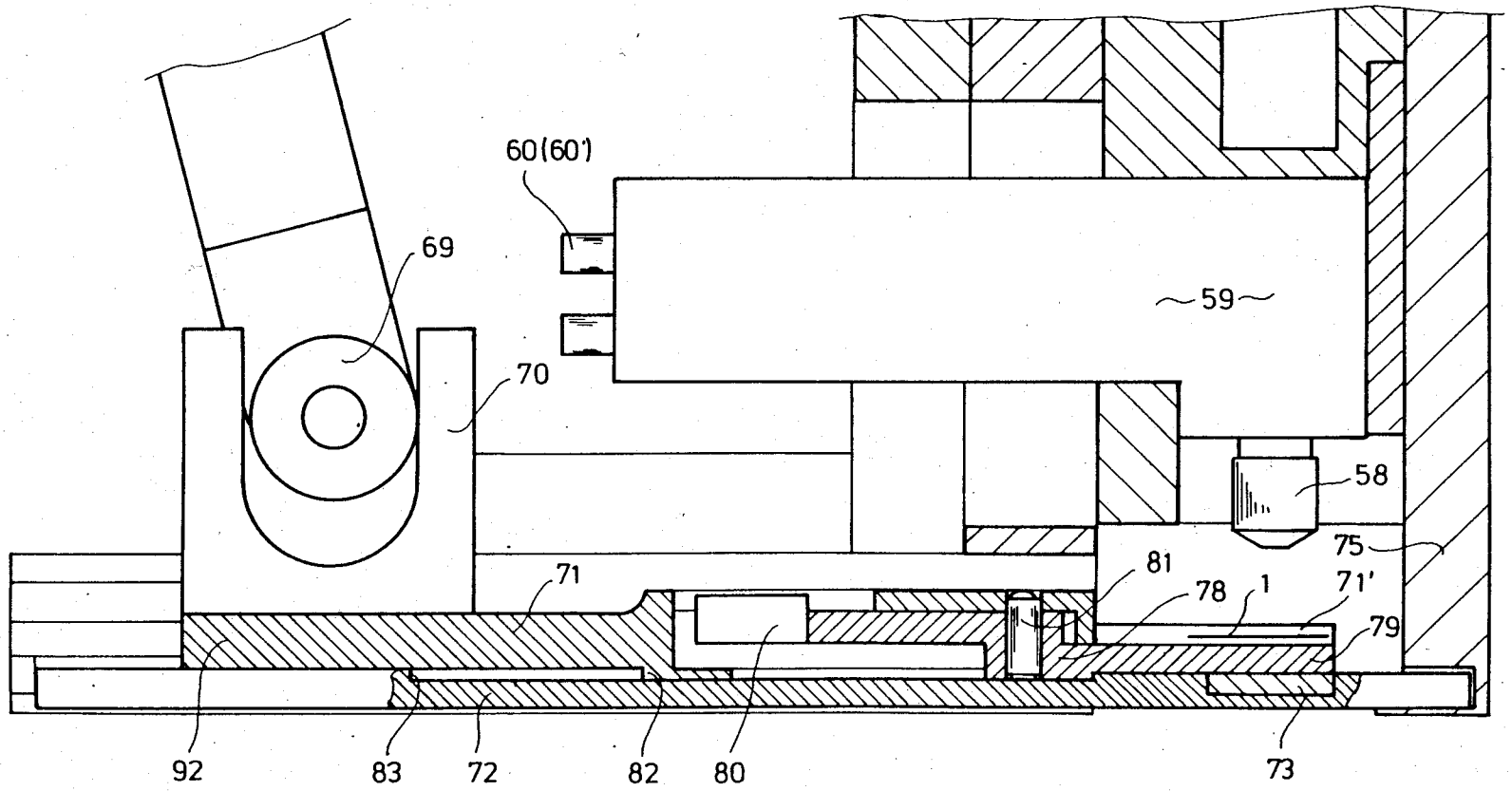
Figure 6B:
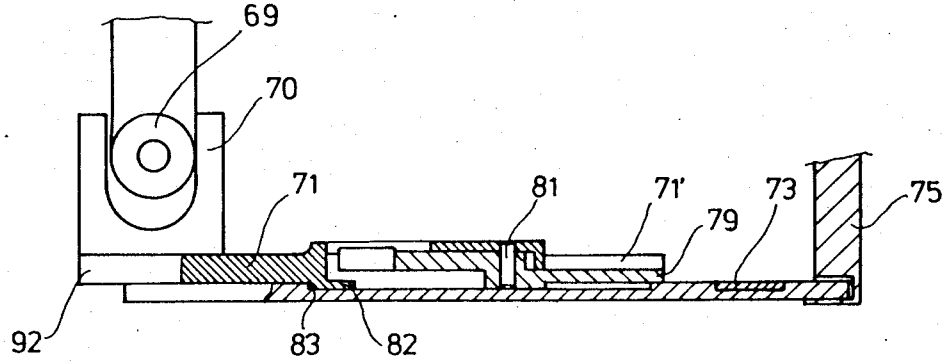
Figure 6C:
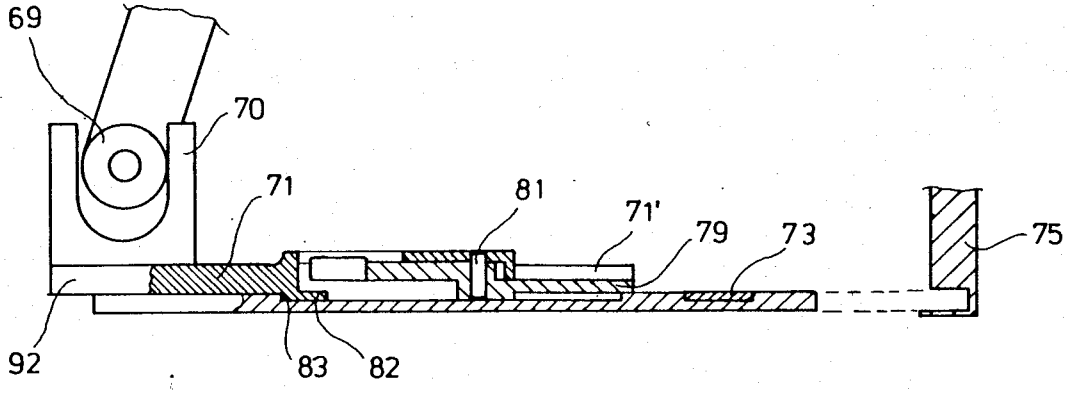
Figure 7:
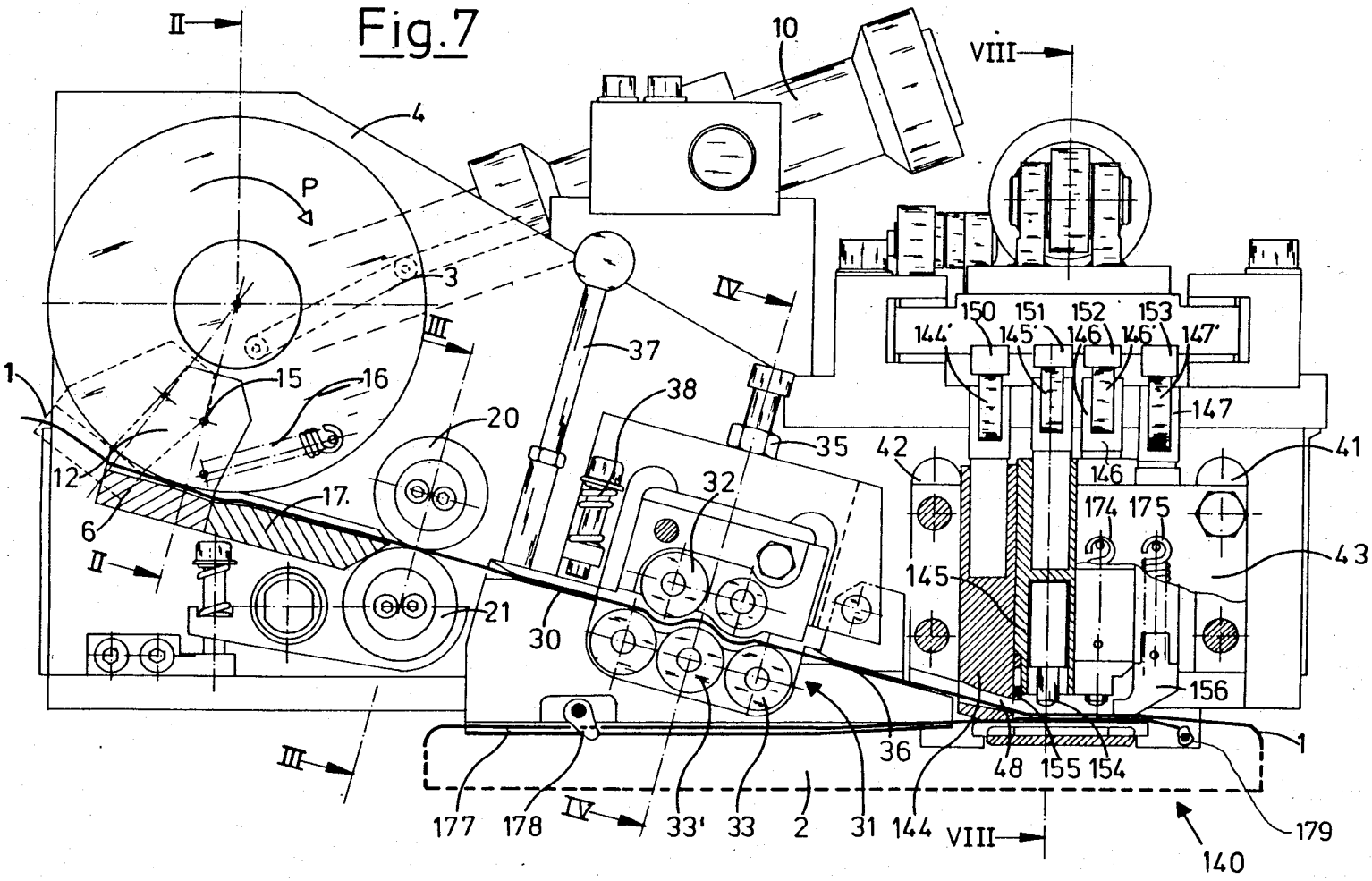

FIGS. 6*a* to 6*c* illustrate various positions of upper and lower slide plates to explain the function thereof;

FIG. 7 shows another embodiment of a tensioning and sealing device; and

Figure 8:
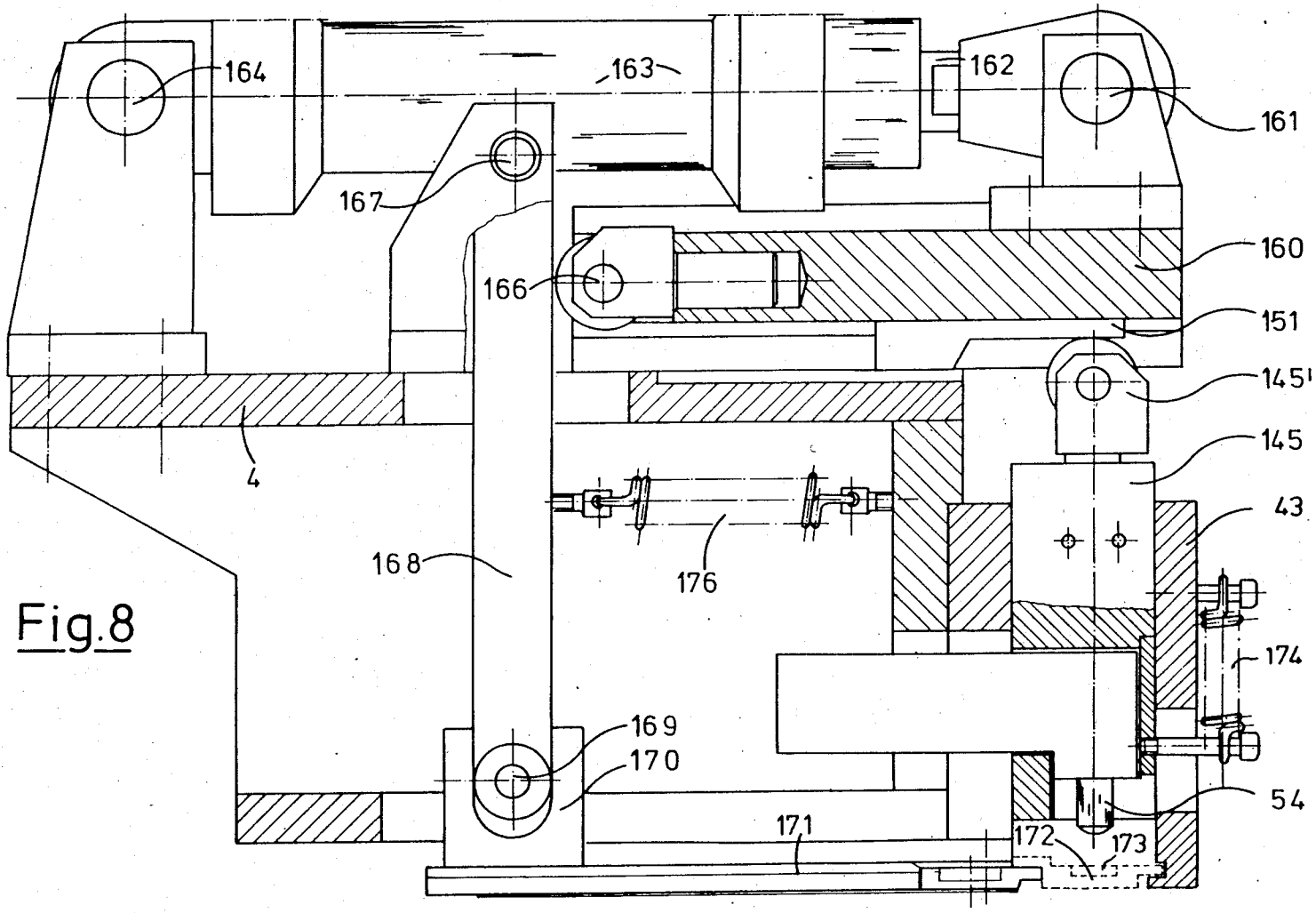

FIG. 8 is a sectional view along lines VIII—VIII in FIG. 7.

Figure 1:
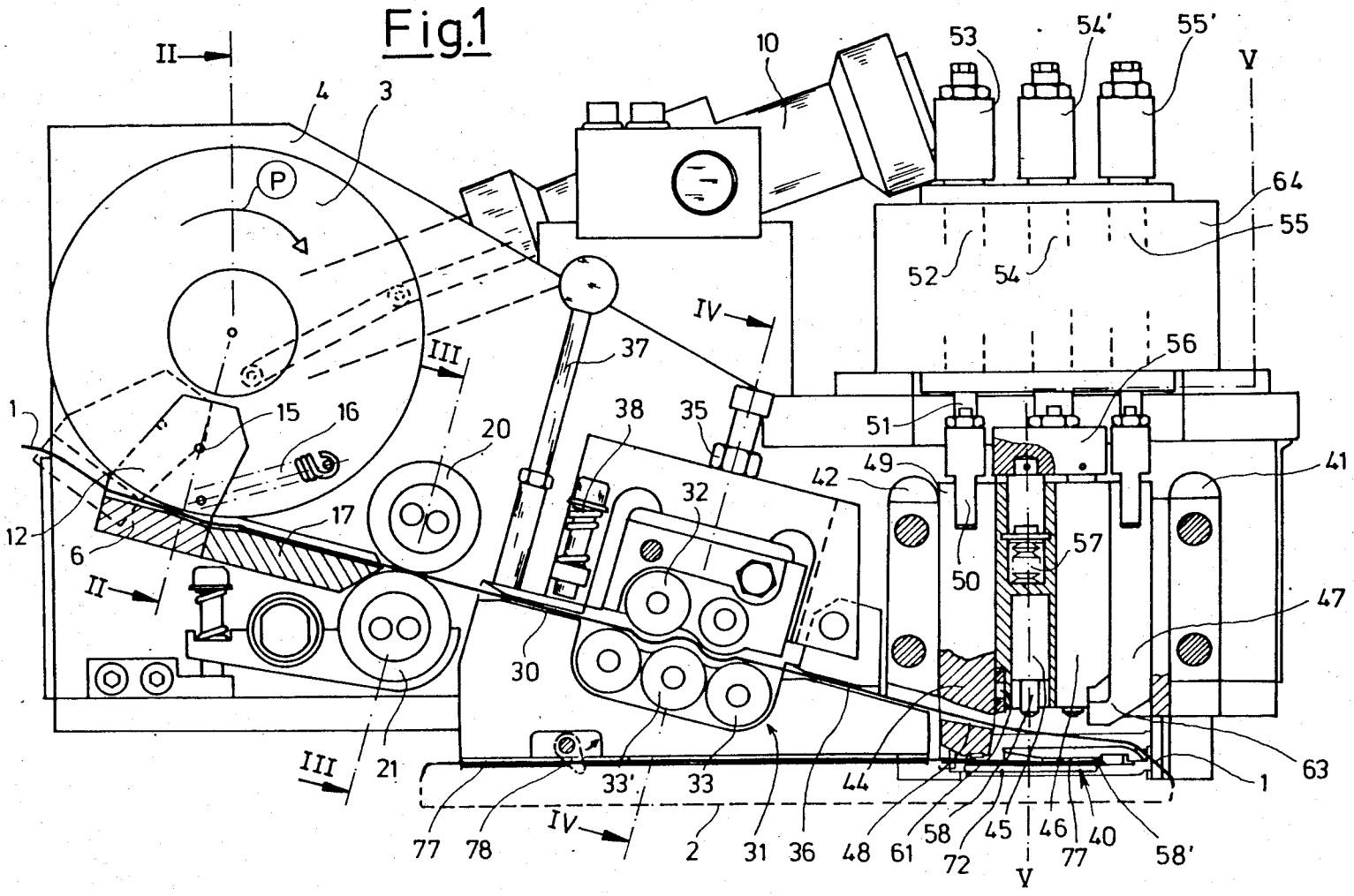
FIG. 1 is a side elevational view of the tensioning and fastening device including the separate assemblies for tensioning and fastening.

FIG. 1 shows in side elevational view the functional side of a tensioning and fastening device for an automatic wrapping machine. By means of frame-like guide means, not shown here, a wrapping band 1 may be passed around an article, e. g. a coil, a bale or the like. In FIG. 1 the course of the wrapping band 1, which extends at the side or below the tensioning and fastening device, is indicated by a loop 2 shown in broken lines. For the successive wrapping operations, the wrapping band is unreeled from a supply reel (not shown). The various subassemblies of the tensioning and sealing device are described below in accordance with the tape passage.

As a wrapping band, a conventinal steel band or strip of different widths is used, which may be employed in automatic wrapping machines of this type. However, it should be noted that with the use of a corresponding welding or heat sealing device, as will be explained below, a plastic band or tape of a conventional type may be used, too.

Figure 2:
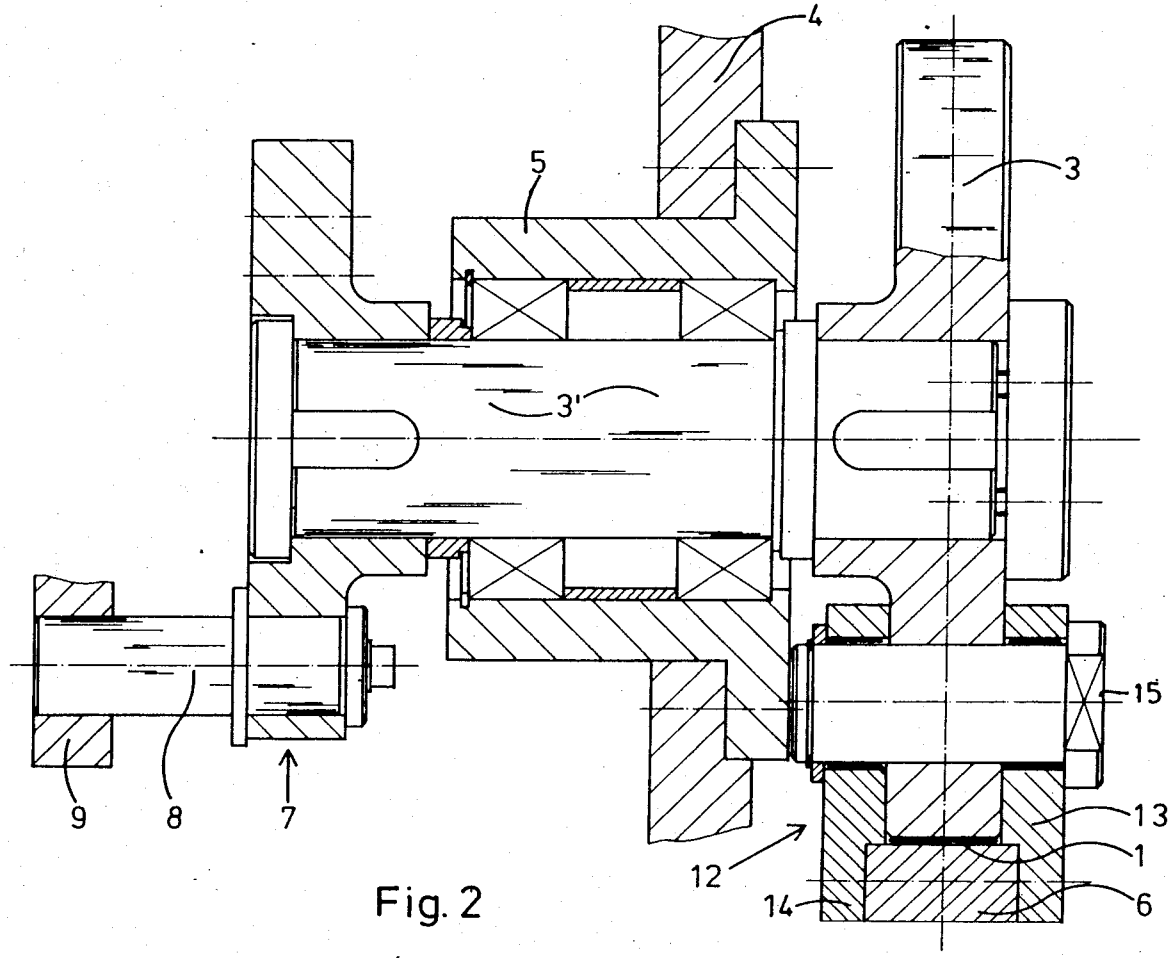
FIG. 2 is a sectional view along lines II—II in FIG. 1.

Tension wheel and clamp bar (see FIGS. 1 and 2)

The wrapping band 1, coming from a supply reel, enters a slot below a tension wheel 3, which slot is formed by the lower periphery of the tension wheel 3 and a movably positioned clamp bar 6. The tension wheel 3 is rotatably mounted in the machine frame 4. To this end, a bearing 5 is provided which mounts the shaft 3'. The rear end of the shaft 3' is provided with a crank drive mechanism 7 the excentric crank arm 8 of which is connected to the rod 9 of a piston-cylinder assembly 10. The tension wheel 3 can be rotated by the piston-cylinder assembly 10. The forces (power) and the rate of feed of the piston-cylinder assembly 10 may be determined by a control device (not illustrated).

The tension wheel 3 the thickness of which corresponds to the width of the band, mounts in the region of band entrance a clamp rocker lever 12 which, in turn, mounts the clamp bar 6 disposed transversely of the band peripery, with the effective surface of this clamp bar 6 being positioned tangentially to the circumference of the tension wheel 3. The pair of rocker lever arms 13, 14 associated with the clamp rocker lever 12 each extend along one side of the tension wheel 3 and are mounted for reciprocating movement at 15. A tension spring 16 biases the clamp rocker lever 12 in counterclockwise direction (in FIG. 1). When the tension wheel 3, as shown in FIG. 1, is in its waiting or ready position, the clamp bar 6 abuts the end side of a band guide bar 17. The band guide bar 17 supports on its upper side the wrapping band 1. Reference may be made to the fact that when the tension wheel moves in the clockwise direction, as indicated by arrow P, the clamp bar 6 is released from the band guide bar to securely clamp under the spring force the wrapping band 1 disposed between the clamp bar 6 and the outer side of the tension wheel 3. This clamping action increases with a increase of torque in the direction of P.

Figure 3:
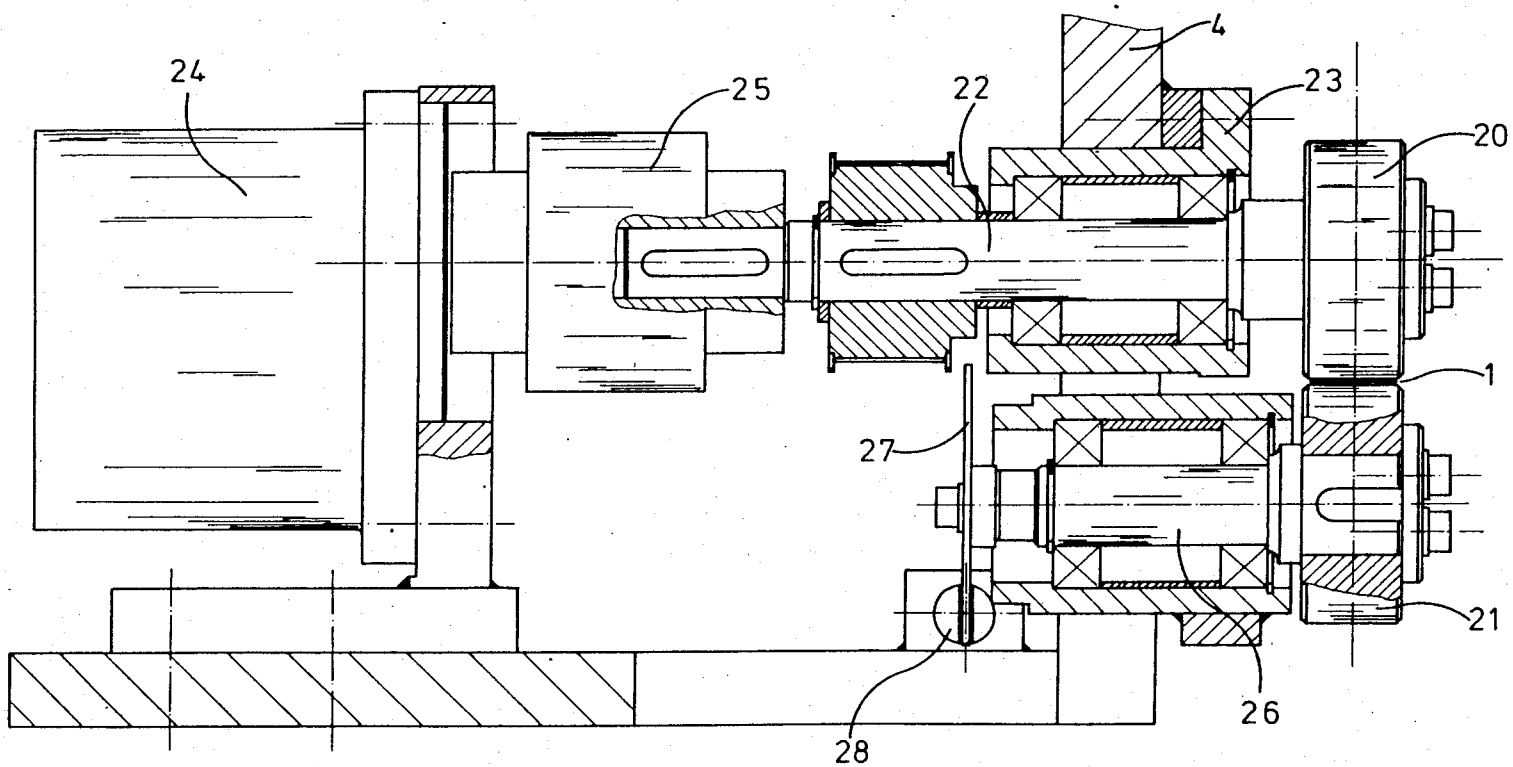
FIG. 3 is a sectional view along lines III—III in FIG. 1.

Driving rollers (compare FIGS. 1 and 3)

Carried on the upper side of the band guide bar 17, the wrapping band 1 moves to the contact portion or nip between a pair of driving rollers 20, 21 which are driven in opposite directions and which are pressed against each other. The pair of driving rollers 20, 21 have their outer surfaces provided with a friction-increasing and even plastic coating, preferably of polyurethane. This coating prevents damage to the wrapping band 1. Accordingly, a limited propelling force only can be produced by the driving rollers 20, 21. The upper driving roller 20 is driven by a hydraulic motor 24 via a shaft 22 which is mounted for rotation in the machine frame 4 to 23. Connected between the driving roller and the shaft is a coupling. When the driving roller 20 is stationary, the hydraulic motor 24 transmits a limited torque only to the driving roller 20. The driving roller 21 is driven in a direction opposite to that of the driving roller 20 by the band 1 passing through between these rollers. No extra driving mechanism is provided for this roller (21). The driving roller 21 has mounted to its shaft 26 a stroboscopic disk 27 adapted to be monitored or controlled by an optical standstill indicator 28.

Figure 4:
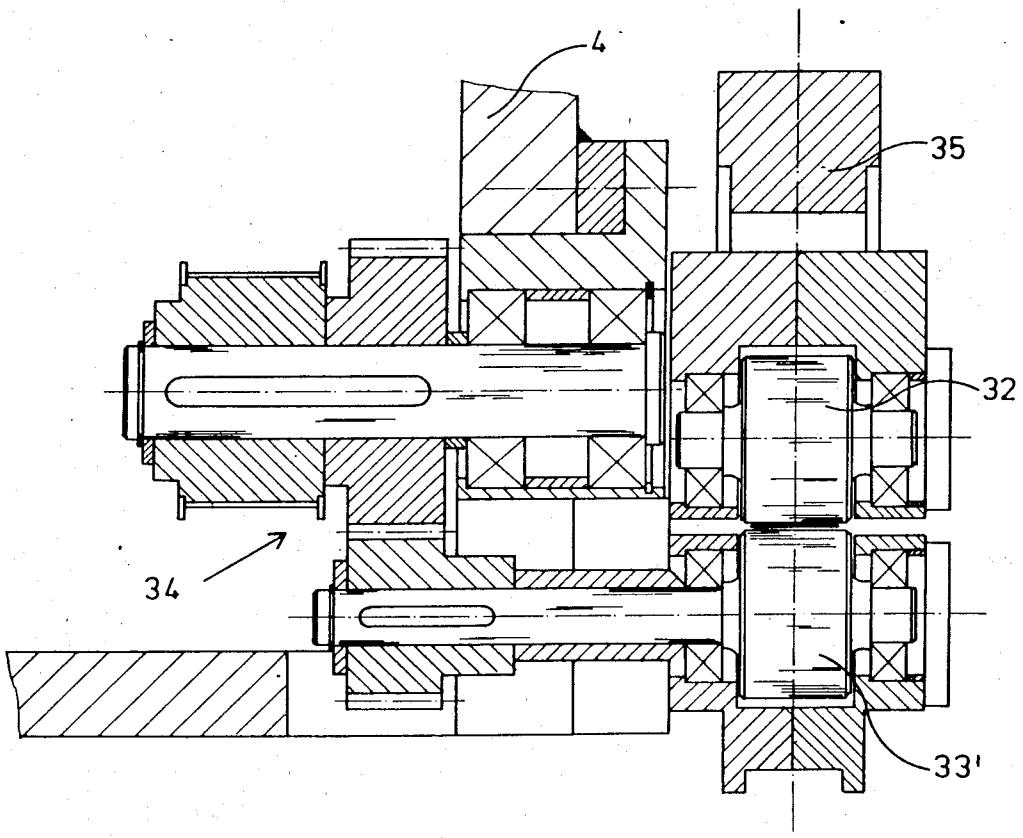
FIG. 4 is a sectional view along lines IV—IV in FIG. 1.

Straightening mechanism (see FIGS. 1 and 4)

From the region of the driving rollers 20, 21, the wrapping band 1 enters a straightening mechanism 31 placed in front of the machine frame 4. The straightening mechanism is operative to straighten the wrapping band prior to the further processing thereof, in such a manner that even low-quality wrapping bands can be handled.

The straightening mechanism 31 comprises five relatively staggered straightening rollers 32. 33. The lower three straightening rollers 33 are mounted in the machine frame. The center roller 33' is coupled to drive means. The upper straightening rollers 32 may be screwed down in parallel by means of a setting screw 35. In this manner, the position of the wrapping band can be adjusted precisely.

The straightening mechanism 31 is divided within the supply channel 30 which joins a discharge channel 36, and between the upper and lower straightening rollers, and it may be opened by means of a snap closure comprising a lever 37 and a pressing spring 38.

Holding and welding station (see FIGS. 1, 5 and 6*a* to 6*c*): First embodiment

From the discharge channel 36, the wrapping band 1 exits from the straightening mechanism 31 to enter a holding and welding station 40. The holding and welding station 40 is defined by a pair of posts 41 and 42 which are threadingly mounted to the machine frame 4 and which support a plate 75 which is not shown in FIG. 1 for clarity. But which appears in FIG. 6*a*. Arranged between the posts 41 and 42 are in side-by-side relation four columnar plunger elements 44, 45, 46 and 47 which are each movable vertically.

The first plunger element 44 constitutes the first holding plunger which includes in the foot or base portion thereof a supply channel 48 for the wrapping band 1 to be guided in a loose state. The first holding plunger continues in the upward direction in a mounting head 49 which receives a mounting fork 50 in a depression permitting for slight escape movement between the mounting fork 50 and the holding plunger 44. The mounting fork 50, in turn, is supported by the end of a piston rod 51 connected to a piston which is movable in a piston-cylinder assembly 52 and adapted to be controlled through a control valve 53. Two further piston-cylinder assemblies 54 and 55 are combined with the first mentioned assembly (52) within a system block and enclosed by a housing 64. These assemblies are controlled by associated control valves 54' and 55'.

Slidably mounted adjacent to the first plunger element 44 are the second and third plunger elements 46, 46 which are both movable simultaneously and also supported from the same piston-cylinder assembly 54. To this end, the plunger elements 45 and 46 are provided with a common support head 56 in which these elements are held. Positioned in the interior of the two plunger elements 45 and 46 are cup (or Belleville) springs 57 which provide for uniform contact pressure of an electrode head 58 or 58', respectively, even in the case of slight consumption thereof. Spring elements of this type are essential since exact compensation cannot be ensured by the hydraulic system alone. Accordingly, the two plunger elements 45 and 46 including the electrode heads 58 and 58' are positioned in such a manner that the electrode heads are adapted to slide downwards simultaneously and under identical pressing forces, and can be returned in upward direction.

Associated with the electrode head 58 is a suitable large-volume cooling housing 59 which is provided with connectors 60, 60' for cooling water supply. In addition, the electrode head 58 is provided, in well-known manner, with suitable insulation devices, power supply means and the like which are not shown in detail.

Still further, the plunger element 45 also includes a shear blade 61 which is mounted laterally above the electrode head 48 and which slides along the side of the first plunger element 54, whereby the wrapping band 1 fed from the supply channel 48 may be cut in the vicinity of the first plunger element 44.

The final plunger element 47 comprises another holding plunger. By means of a holding (or presser) foot 63, the severed band end is pressed onto the end of the previously formed band loop 2 and held thereon. This plunger element 47, too, can be operated by a corresponding piston-cylinder assembly 55 with an associated valve 55'.

Figure 5:
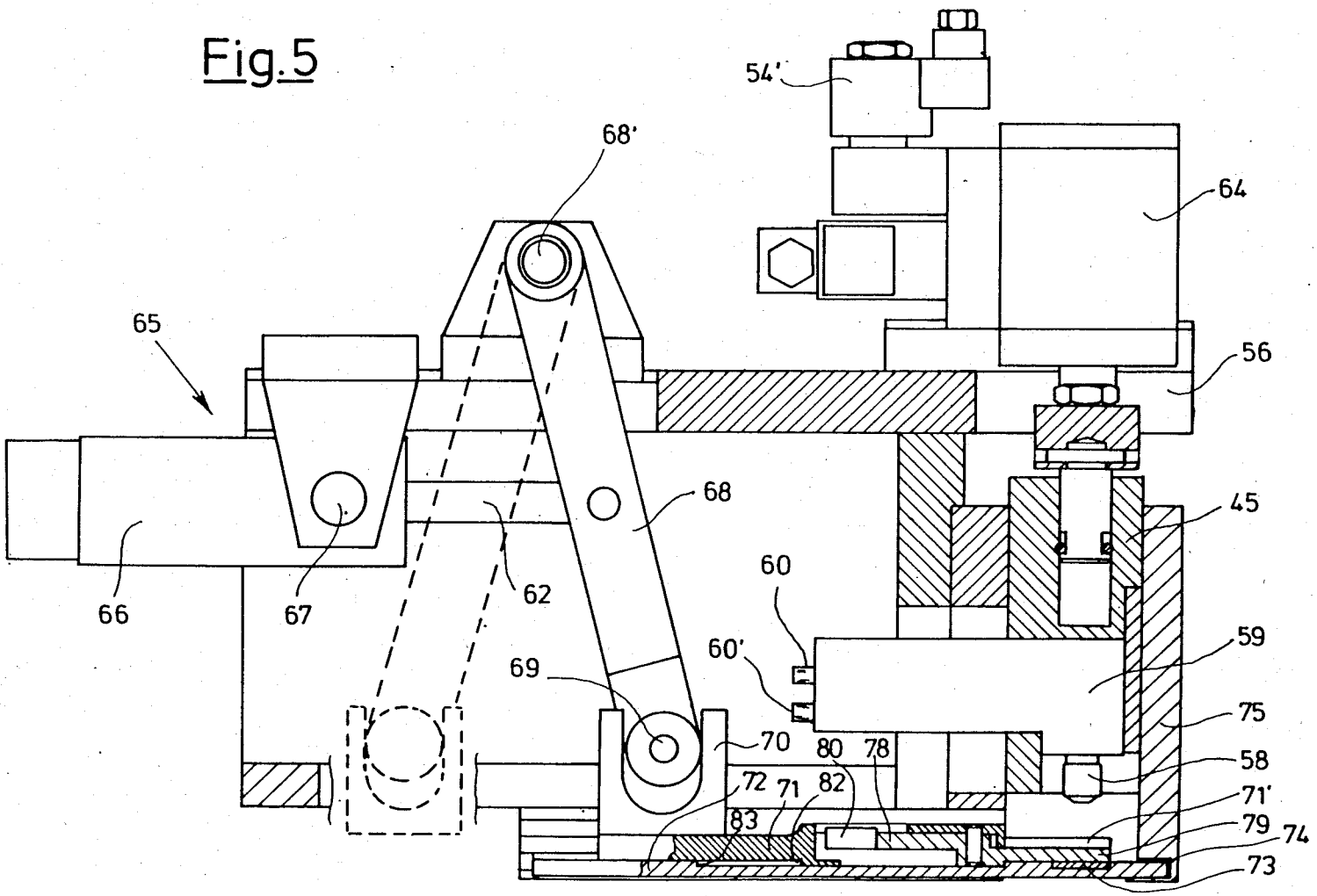
FIG. 5 is a sectional view along line V—V in FIG. 1.

Further details of the construction can be seen from the sectional view of FIG. 5. Above the plunger elements 44 to 47, the cylinders of the piston-cylinder assemblies 52, 54 and 55 for verticaly moving the plunger elements are received in a housing 64. The piston rods extend downwards out from the housing 64.

A further, horizontally operating piston-cylinder assembly 65 has its cylinder 66 pivotally mounted to the machine frame 4 at 67. The piston rod 62 moves a guide lever 68 which has its upper end (68') suspended from an arm. The guide lever 68 terminates at its lower end 69 in a shoe 70 which is connected to an upper slide plate 71. The upper slide plate 71 is slidingly guided on a lower slide plate 72 having embedded in the front end thereof a counter electrode 73 which may be formed also as a shortcircuiting plate. When the electrodes are pressed down and the band ends are placed one upon the other, a circuit is closed which permits the welding operation to take place. In the extreme right position of the lower slide plate 72, as shown in FIG. 6*a*, this slide plate is held and supported in a groove 74 formed in the plate 75. Upper and lower slide plates 71 and 72, respectively, are provided with displaced stops. In the extreme right position of both plates 71 and 72, the upper slide plate 71 covers with its end portion 71' the counter electrode 73 such that the band 1 passes above the lower plate 72. As shown in FIG. 1, a laterally opening funnel or guide channel 77 is provided in the upper slide plate.

Furthermore, mounted in the upper slide plate 72 is a stop or abutment lever 78 which includes a stop head 79 and a trigger foot 80 and which is mounted for rotation at 81. Thus, the trigger foot 80 moves toward the viewer as seen in FIG. 6*a* when the stop head 79 moves away from the viewer. Through a microswitch (not illustrated) which is also installed in the upper slide plate 71, the trigger foot triggers a switching pulse upon approcimation (to the microswitch). The stop lever 78 is returned to the starting position by means of a resetting spring element (not shown).

FIGS. 6*b* and 6*c* illustrate the various positions of the upper and lower slide plates 71, 72 relative to each other. In FIG. 6*a*, the band 1 is threaded in, and the stop head 79 is released or triggered. Under this switching pulse, the lever 68 moves to the left with the piston rod 62 until the stop 82 abuts the stop face 83 of the lower door plate. Thereby, the upper door plate is displaced to such a degree that the end 71' uncovers the counter electrode 73. Then, the wrapping band 1 is positioned precisely above the counter electrode and below the electrode 54. The welding operation is initiated when the electrode 54 moves down and generates a current pulse. Then, the upper plate 71 moves still farther to the left, pulling with it the lower slide plate 72, whereby the welded band loop is released.

Following this operation, the former position of slide plates 71 and 72 may be re-established with a reversed sequence.

Holding and welding station (see FIGS. 7 and 8): Second embodiment

In the second embodiment shown in FIGS. 7 and 8, the wrapping band is likewise extended through the discharge channel 36 from the straightening mechanism 31 into a holding and welding station 140. The holding and welding station 140 is defined or bound by a pair of lateral posts 41 and 42 which are threadingly mounted to the machine frame 4 and which carry a housing plate 43. This housing plate 43 is shown in a partially broken state in FIG. 7 to reveal the portions disposed below (behind) this plate. Mounted behind the housing plate 43 in side-by-side relation are four columnar plunger (or ram) elements 144, 145, 146 and 147 which are each movable vertically.

The first plunger element 144 constitutes the first holding plunger (or ram) which has in the foot or base portion thereof a supply channel 48 for the wrapping band 1 to be inserted in a loose state. The first holding plunger extends upwards to a push rod 144' which ends beneath a region (plane) over which a cam 150 moves. In order to avoid that the force of the plunger is applied to the basis uncushioned, the plunger element 144, same as the plunger elements 145 to 147 to be described below, is provided with cup spring means.

Slidably mounted adjacent to the first plunger element 144 is the second plunger element 145 which is provided with an electrode head 154. The electrode head 154 is equipped with suitable insulation devices, power supply means and the like, in conventional manner. Further, the plunger element 145 includes a shear blade 155 which is mounted laterally and above the electrode head 154 and which slides along the side of the first plunger element 144, whereby the steel band 1 fed through the supply channel 48 can be cut or sheared in the vicinity of the plunger element. Positioned adjacent to the plunger element 145 is another plunger element 146 which is also provided with an electrode head. Both plunger elements 145 and 146 terminate in push rods 145' and 146', respectively, disposed below further cams 151, 152. The cams 151 and 152 are arranged so that the electrode headsslide down simultaneously and to the same extent.

The final plunger element 147 is another holding plunger. By means of a holding foot 156, the severed band end is pressed onto the previously formed band loop 2, to be held thereon. This plunger element 147, too, is operated by push rod 147' through a cam 153.

The sectional view of FIG. 8 illustrates the construction. Provided above the plunger elements 144 to 147 is a rectilinearly movable slider 160 which is provided with the cams 150 to 153 on the lower side and which is formed as a laterally (movably) guided plate. Securely mounted above the slider 160 is a holding link or bracket 161 which is connected to the piston rod 162 of a piston-cylinder system 163. The cylinder of the system 163 is, again, securely connected to the machine frame 4 at 164. With retraction and extension of the (piston) rod 162 into and from the system 163, the slider 160 is accordingly moved to and fro in horizontal direction along with the cams 150 to 153. As will be explained in the functional description below, the plunger elements 144 and 147 are pressed down when they are engaged by the cams.

The rear end of the slider 160 is provided with a stop or abutment roller 166 which pressed against a guide lever 168 pivotally suspended at 167. The guide lever 168 is formed as a single-arm lever, and its lower end terminates in a shoe 170. The shoe 170, in turn, is connected through a rod 171 to a slidingly guided shortcircuiting plate 172 which, likewise with a horizontal sliding movement, may be withdrawn from its position below the pair of electrode heads 154. The shortcircuiting plate 172 is formed of a conductive material, e.g. copper, in the contact region. Of course, this plate is insulated relative to the remainder of the machine frame and the rod 171.

The plunger elements 144 to 147 are adapted to be drawn back to their upper positions in opposition to the direction of movement determined by the four cams 150 to 153, by means of four tension springs 174, 175 each associated with one plunger element, as soon as the cams are withdrawn from the push rod contact position. Analogously the same hold true with respect to the withdrawal of the shortcircuiting plate 172. The latter is likewise returned to the closing position by a spring 176 upon retraction of the slider.

Summarizing, the holding and welding station including the plunger elements which are positioned directly in side-by-side relation, is capable of performing the clamping, cutting and welding with a relatively short band section, on a short path and within a minimum space.

The above-mentioned band loop 2 which is fed out from the holding and welding statin 140 to surround the article to be wrapped, is re-inserted through a guide channel 177 which is provided with a switch 178 adapted to be actuated by the band end. By means of this switch, the speed of propelling (or feed) of the band 1 is reduced. Further, the holding and welding station has attached thereto a limit switch 179 which is operated by the arriving tip end of the band and which deactivates the propelling or feeding of the band.

Functional description

In order to "thread in" the wrapping band 1, the latter is introduced between the tension wheel 2 and the clamp bar 6 which are sufficiently spaced from each other, and the band is pushed forward up to the contact region between the driving rollers 20, 21. When the driving rollers 20, 21 have been moved against each other, the band is passed through the supply channel 30, the straightening mechanism 31 and the discharge channel 36. At this time, all plunger elements 144 to 147 are moved to the upper position; the slider 60 is moved (extended) to the front side of the machine frame 4 to such an extent that the lever 168 is released, whereby the contact plate 172 is retracted to the position shown in broken lines in FIG. 8 to close the channel of the holding and welding station 140. Now, the band can be pushed freely through this channel.

By means of suitable conventional guide means, the band is placed and guided around the article to be wrapped, and the band finally enters the lower guide channel 177 again. Thereby, the switch 178 is operated which is connected through a suitable control line to the hydraulic motor 24 the speed of rotation of which is reduced such that the driving roller 20, 21 rotate at a lower speed, too. Then, the tip end of the wrapping band is introduced at a reduced speed through the channel 177 into the holding and welding station, so as to come to lie underneath the previously inserted band forming part of the band loop. Upon downward movement of the individual plungers, the limit switch 179 first stops the further band feed, and then opens a magnetic (solenoid) valve associated with the piston-cylinder assembly 163, whereby the cam slider 60 moves forward over a short distance (to the right according to FIG. 5). Hereby, the first cam 150 is contacted with the push rod 144', whereby the first holding plunger (plunger element 144) is moved down to securely clamp the inserted band end against the shortcircuiting plate. However, the band positioned thereabove is still in a loose (unrestrained) state since it is guided only loosely or freely in the holding plunger through the supply channel 148.

Switch 149 triggers another switch (not shown) which, through a control line, now causes the hydraulic motor 24 to rotate in the opposite direction. Accordingly, the driving rollers 20, 21 now rotate in a direction opposite to their original direction of rotation, whereby the wrapping band 1 is withdrawn through the straightening path and tightly contacted with the article to be wrapped. At this time, the torque of the driving rollers 20, 21 is increased up to a value which may be determined by suitable presetting of the hydraulic motor. Thus, the band is placed under a certain bias or pretension. The driving rollers come to stop. The standstill monitor (indicator) 28 signals the standstill state to a switching unit which operates another hyraulic valve to actuate the piston-cylinder assembly 10 in such a manner that the tension wheel 3 is rotated in the direction of arrow P. In this way, the clamp rocker lever 12 with the clamp bar 6 released from the stop element and pulled by the spring 16, whereby the wrapping band 1 is clamped tightly. Thereafter, the band is tightened under a further tension which may be adjusted through the driving force of the piston-cylinder assembly 10, whereby the driving rollers 20, 21 are also rotated slightly. As soon as the tension force is reached which may be preset in the control unit 11, the control valve for the piston-cylinder assembly 163 is actuated again through the respective control circuit, which assembly then causes the slider 160 to be projected over a further distance to the right (as seen in FIG. 8). Thereby, the other holding plunger 147 is pressed onto the now tightened wrapping band 1 and the band end disposed therebelow. These two parts are likewise held or clamped. Upon further projection of slider 160, the two plunger elements 145 and 146 are lowered. At first, the blade 155 severes the band whereby a wrapping loop separted from the remainder of the band supply is formed. Then, the two electrode heads 154, 154' are pressed tightly against the overlapping portion of the band loop. The welding current is turned on. The shortcircuiting plate provides a high current whereby two welding points are formed in the electrode head area. Thereafter, the current is turned off, and the slider 160 is retracted. Under the spring force, the electrodes separate from the band loop, and the two holding plungers 144 and 147 are separated from the overlapping portion. The slider 160 is retracted until it engages the lever 68, thereby to withdraw the shortcircuiting plate from the electrode region. Thus, the band loop is allowed to drop down. Owing to the tension built up in the band loop, the band loop is further released from the guide channel 177 which is provided with trapdoor-like closing metal plates adapted to swing down. The wrapped article can be taken out with a wrapping band applied thereto in a fully automatic manner.

The apparatus if lifted off the wrapped article. The slider 160 returns to the initial position, such that the shortcircuiting plate 172 can return to its original position, too. Furthermore, the tension wheel is returned or retracted, thereby to release the clamp bar. The driving rollers start to rotate to cause a new wrapping operation to be started.

The apparatus according to FIGS. 1, 5, 6*a* to 6*c* is different in its funtioning only with respect to the upper and lower slide plates. Furthermore, hydraulic control means are provided for the plunger elements in the place of the cam control means. The functioning is equivalent to that described above, and can be readily understood from the respective description of the Figures.

I claim:

1. An automatic wrapping machine including guide means for guiding a wrapping band from a supply, a loop forming means for looping said wrapping band around an object to be wrapped and a tensioning and fastening device for the wrapping band, said tensioning and fastening device comprising:

a main frame member;

first driving means mounted to said main frame member for driving said wrapping band through the tensioning and fastening device;

tensioning means mounted to said main frame member for tensioning said wrapping band against the direction of driving;

first and second holding plungers slidably mounted to said frame member for holding first and second ends, respectively, of said wrapping band in an overlapping area of a wrapping loop formed by said loop forming means;

at least one electrode plunger slidably mounted to said frame member between said holding plungers for movement substantially perpendicular to said overlapping area;

second driving means for moving said holding plungers and said at least one electrode plunger toward and away from said overlapping area;

moveable plate means operatively coupled to and disposed below said at least one electrode plunger, said moveable plate means including an upper slide plate member and a lower slide plate member slidably coupled together and each including stops for limiting the sliding movement thereof relative to the other plate member;

a counter electrode element mounted to an end of said movable plate means; and means for reciprocally moving said moveable plate means relative to said frame member in a plane parallel to said overlapping area of said wrapping loop.

2. An automatic wrapping machine as in claim 1, wherein said means for reciprocally moving said moveable plate means includes a lever arm rotatably mounted at a first end thereof to said frame member and at a second end thereof to a shoe element mounted to said upper slide plate member.

3. An automatic wrapping machine as in claim 1, wherein said counter electrode element is mounted to said lower slide plate and said upper slide plate member includes a guide channel for receiving and guiding said wrapping band so as to complete said wrapping loop, said guide channel being positioned so as to guide said wrapping band over said counter electrode.

4. An automatic wrapping machine as in claim 1, wherein said upper slide plate member includes a stop lever member rotatably mounted therein, said stop lever member being adapted to be engaged and rotated by the end of said wrapping band to thereby control wrapping band feed.

5. An automatic wrapping machine as in claim 1, further comprising a housing plate member mounted to said frame member and including a groove for receiving an end of said lower slide plate member to thereby hold and support said lower slide plate member to limit the sliding movement thereof.

6. An automatic wrapping machine as in claim 1, wherein said tensioning means includes:

a tension wheel mounted to said frame member;

a clamp bar, mounted to said frame member so as to be disposed tangentially to the circumference of said tension wheel, said wrapping band being received between said tension wheel and said clamp bar; and means for moving said tension wheel so as to increase the tension on said wrapping band.

7. An automatic wrapping machine according to claim 6, wherein said tensioning means further includes a hydraulic piston-cylinder-assembly mounted to said frame member and a crank drive for rotating said tension wheel coupled to each end thereof to said hydraulic piston-cylinder-assembly and said tension wheel, respectively.

8. An automatic wrapping machine according to claim 6, wherein said driving means comprise first and second rollers driven in opposite directions so as to drive therebetween said wrapping band, said rollers each having a smooth and even plastic coating on the periphery thereof.

* * * * *